United States Patent [19]

Sharma

[11] Patent Number: 4,616,196

[45] Date of Patent: Oct. 7, 1986

[54] MICROWAVE AND MILLIMETER WAVE SWITCHED-LINE TYPE PHASE SHIFTER INCLUDING EXPONENTIAL LINE PORTION

[75] Inventor: Arvind K. Sharma, Cranbury, N.J.

[73] Assignee: RCA Corporation, Princeton, N.J.

[21] Appl. No.: 695,523

[22] Filed: Jan. 28, 1985

[51] Int. Cl.[4] ..... H01P 1/18

[52] U.S. Cl. ..... 333/161; 333/104

[58] Field of Search ..... 333/164, 161, 156, 157, 333/246, 101, 103, 104

[56] References Cited

U.S. PATENT DOCUMENTS

| | | | |
|---|---|---|---|
| 3,471,808 | 10/1969 | Felsenheld | 333/161 |
| 3,568,097 | 3/1971 | Hyltin | 307/303 X |
| 3,568,105 | 3/1971 | Felsenheld | 333/161 |
| 4,195,271 | 3/1980 | Schiek et al. | 333/161 |
| 4,238,745 | 12/1980 | Schwarzmann | 333/164 |
| 4,254,383 | 3/1981 | Wolfe | 333/246 X |
| 4,383,227 | 5/1983 | de Ronde | 333/246 X |

FOREIGN PATENT DOCUMENTS

| | | | |
|---|---|---|---|
| 2704202 | 8/1978 | Fed. Rep. of Germany | 333/161 |
| 2747871 | 5/1979 | Fed. Rep. of Germany | 333/161 |

OTHER PUBLICATIONS

Schick, Burkhard & Kohler, Jurgen; "A Method of Broad Band Matching of Microstrip Differential Phase Shifters"; IEEE Transaction on MTT; vol. MTT 25, No. 8, 8/1977, pp. 666–672.

"An Octave-Band Switched Line Microstrip 3-b Diode Phase Shifter", R. P. Coats, *IEEE Transactions on Microwave Theory and Techniques,* vol. MTT-21, Jul. 1973.

"Broadband Diode Phase Shifter", R. V. Graver, *IEEE Transactions on Microwave and Theory and Techniques,* vol. MTT-20, May 1972, pp. 314–323.

"Coupled Non-Uniform Transmission Line and Its Applications", S. Yamamoto et al., *IEEE Transactions on Microwave Theory and Techniques,* vol. MTT-15, Apr. 1967, pp. 220–231.

*Primary Examiner*—Eugene R. LaRoche
*Assistant Examiner*—Benny Lee
*Attorney, Agent, or Firm*—Joseph S. Tripoli; Robert L. Troike; Robert Ochis

[57] ABSTRACT

A switched-line type phase shifter employs a reference, uniform transmission line and a coupled exponential transmission line. The coupled exponential line network provides a different phase shift but provides a phase shift versus frequency characteristic that over a wide frequency band matches the reference line.

5 Claims, 5 Drawing Figures

MICROWAVE AND MILLIMETER WAVE SWITCHED-LINE TYPE PHASE SHIFTER INCLUDING EXPONENTIAL LINE PORTION

The government has rights in this invention pursuant to Contract No. F19628-83-C0073 awarded by the Department of the Air Force.

BACKGROUND OF THE INVENTION

The present invention relates to switched-line type phase shifters for use at microwave and millimeter wave frequencies.

Switched-line type phase shifters can be either transmission type (two-port) or reflection type (one-port) phase shifters. A switched line type phase shifter which provides a selectable relative phase shift of either 0° or $\phi°$ includes two different transmission lines and a switch system for selecting either one as the transmission path to be followed by the signal to be phase shifted. The transmission line which constitutes the signal path when a relative phase shift of $\phi°$ is selected is made electrically longer than the transmission line which constitutes the signal path when a relative phase shift of 0° is selected. This difference in electrical length is selected to provide a difference in transmission time of $\tau_o$ seconds where $$\phi° = \frac{\tau_o(360°)}{T_o} = \tau_o(360°)F_o,$$

where $T_o$ is the period of a signal at the design operating frequency $F_o$ at which a phase shift of $\phi°$ is desired. As a function of frequency the relative phase shift $\phi$ provided by such a phase shifter is $\phi=(360°)\tau_o F$, where F is the operating frequency. Thus, the phase shift $\phi$ is a function of frequency.

This frequency dependency of the phase shift provided by a switched-line type phase shifter restricts its use to narrowband systems when tight tolerances are placed on the phase shift provided.

Various systems such as radar and communication systems are desired which operate in the microwave (3 GHz to 30 GHz) and millimeter-wave frequency ranges (30 GHz to 300 GHZ). A number of different components needed for the construction of such microwave and millimeter wave systems are being developed. Many such systems require compact and controllable phase shifters having low loss and low phase variation over a substantial operating frequency band. Switched-line type phase shifters are applicable to this frequency range, however, their use has not been feasible in wideband systems.

It is desirable to provide a compact, electrically controllable, switched-line type phase shifter operating in the microwave and millimeter wave frequency ranges and having low loss and low phase variation over a wide operating frequency band.

SUMMARY

In accordance with one embodiment of the present invention a switched-line type phase shifter operable over a wide frequency band is provided. The phase shifter includes reference and alternate transmission lines either one of which can be connected as the RF signal path through the phase shifter. The reference transmission line has a given phase length and a given phase versus frequency characteristic. The alternate transmission line includes a coupled exponential transmission line (CETL) all-pass network. The coupled exponential transmission line which is included in the alternate transmission line has its length, line width, line separation and taper tailored to provide a phase length different from said given phase length and a phase versus frequency characteristic which substantially matches the given phase versus frequency characteristic whereby the phase shifter exhibits a substantially constant phase-versus-frequency characteristic over the operating frequency range.

DETAILED DESCRIPTION

Figure 1:
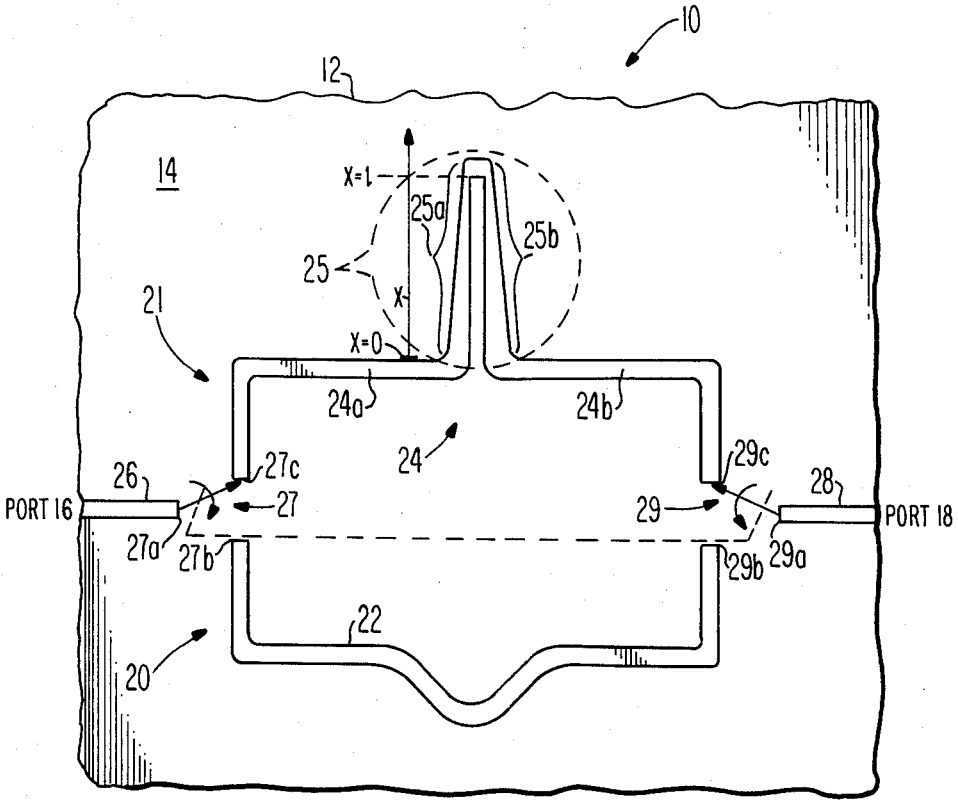
FIG. 1 is a plan view of the strip conductor pattern of a phase shifter in accordance with the present invention.

In FIG. 1 a phase shifter 10 in accordance with the present invention is embodied in microstrip form and comprises first and second ports 16 and 18 which are interchangeable for use as input and output ports. Strip transmission lines of the type having a flat broad substrate with a relatively narrow strip conductor on a face side thereof and a relatively broad ground conductor on a back side thereof are known as microstrip transmission lines. For the microstrip transmission lines to function in accordance with theory, the relatively broad ground conductor must be at least about three times as wide as the relatively narrow strip conductor. The embodiment in FIG. 1 includes a dielectric substrate 12 having first and second major surfaces. A continuous ground conductor (not shown) is disposed on the major surface of the substrate 12 which is hidden from the plan view in FIG. 1. On the major surface 14 which is visible in FIG. 1, a number of individual, relatively narrow, strip conductors are disposed to form microstrip transmission lines with the dielectric substrate and ground conductor. One of these strip conductors 26 connects at a first end to the first port 16 and at a second end to the common terminal 27*a* of a single pole, double throw (SPDT) switch 27. A second one of these conductive strips 28 connects at a first end to the common terminal 29*a* of a SPDT switch 29 and at a second end to the second port 18. Reference microstrip transmission line 20 and alternative microstrip transmission line 21 extend between switch 27 and switch 29. A strip conductor 22 comprises the relatively narrow conductor of the reference, uniform, microstrip transmission 20 line and connects at one end to the first branch terminal 27*b* of switch 27 and at the other end to the first branch terminal 29*b* of switch 29. A strip conductor 24 comprises the relatively narrow conductor of the alternative microstrip transmission line 21 and connects at one end to the second branch terminal 27c of switch 27 and at the other end to the second branch terminal 29c of switch 29.

The switches 27 and 29 are switched together so that their common contacts are both connected to their first branch terminals 27b,29b or both connected to their second branch terminals 27c, 29c to connect either the reference transmission line 20 or the alternate transmission line 21, respectively, between the ports 16 and 18.

Reference transmission line 20 has a given phase length at a particular frequency and the increasing phase length with increasing frequency phase-versus-frequency characteristic of a uniform transmission line.

Strip 24 includes two uniform sections 24a and 24b and two tapered sections 25a and 25b. The tapered sections 25a and 25b together comprise a coupled exponential transmission line (CETL) all-pass network 25. The conductors 25a and 25b of the CETL network 25 are widest where they connect to sections 24a and 24b, respectively and are narrowest where their ends which are remote from conductor sections 24a and 24b connect to each other. The length, width, spacing between and taper of the conductors of CETL 25 is tailored to provide the CETL with a phase length which is greater than that of the reference transmission line by the phase shift desired from the phase shifter and a phase-versus-frequency characteristic which is substantially the same as that of the reference transmission line over the operating range of frequencies. The phase shift through a CETL section is given by $$\phi = 2\tan^{-1}\left[\frac{1}{\sqrt{\rho(0)}\,[p + q\cot\theta]}\right]$$

where $\rho(0)$ is the ratio (at X=0, which is the point where the strips 25a and 25b are widest) of the even mode impedance ($Z_{oe}$) to the odd mode impedance ($Z_{oo}$) and p=exp. ($\mu$l/2)

$\mu$ is the rate of taper l is the length of the CETL section $$q = \sqrt{1 - p^2}$$

$p=\mu/2\beta$ $\beta=(2\pi f)/c$ $\Theta=\beta ql$ $\beta l$ =electrical length of section.

Figure 2:
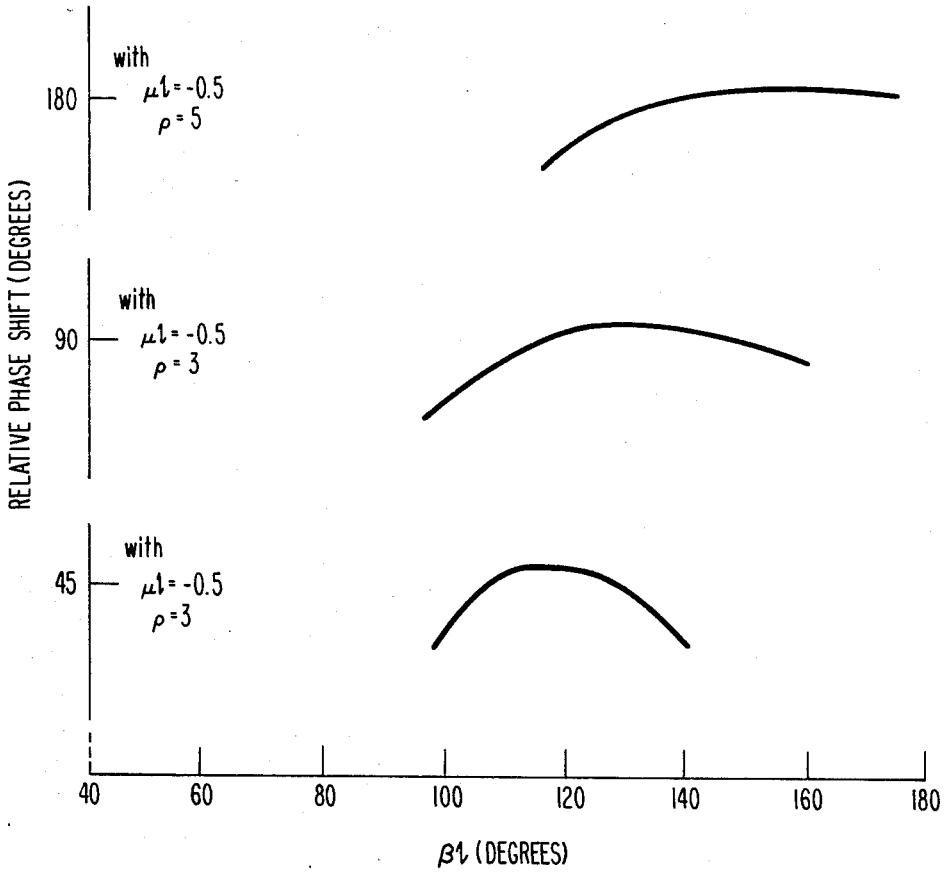
FIG. 2 is a plot of the relative phase shift of the FIG. 1 phase shifter as a function of frequency for three different design values.

Such a CETL section has an asymmetric phase-frequency characteristic. This asymmetric characteristic enables the phase shifter 10 to provide a substantially constant phase shift over a wide band. The phase shift characteristics of a phase shifter 10 are shown in FIG. 2 for three different design phase shift values (45°, 90° and 180°). This performance data is presented in tabular form in the Table.

TABLE

| Phase Shift (degrees) | Operating range for $\beta l$(degrees) | Bandwidth (octave) |
|---|---|---|
| 45° ± 2° | 105–132 | 0.257 |
| 90° ± 2° | 110–155 | 0.40 |
| 180° ± 2° | 130–180 | 0.39 |

Figure 3:
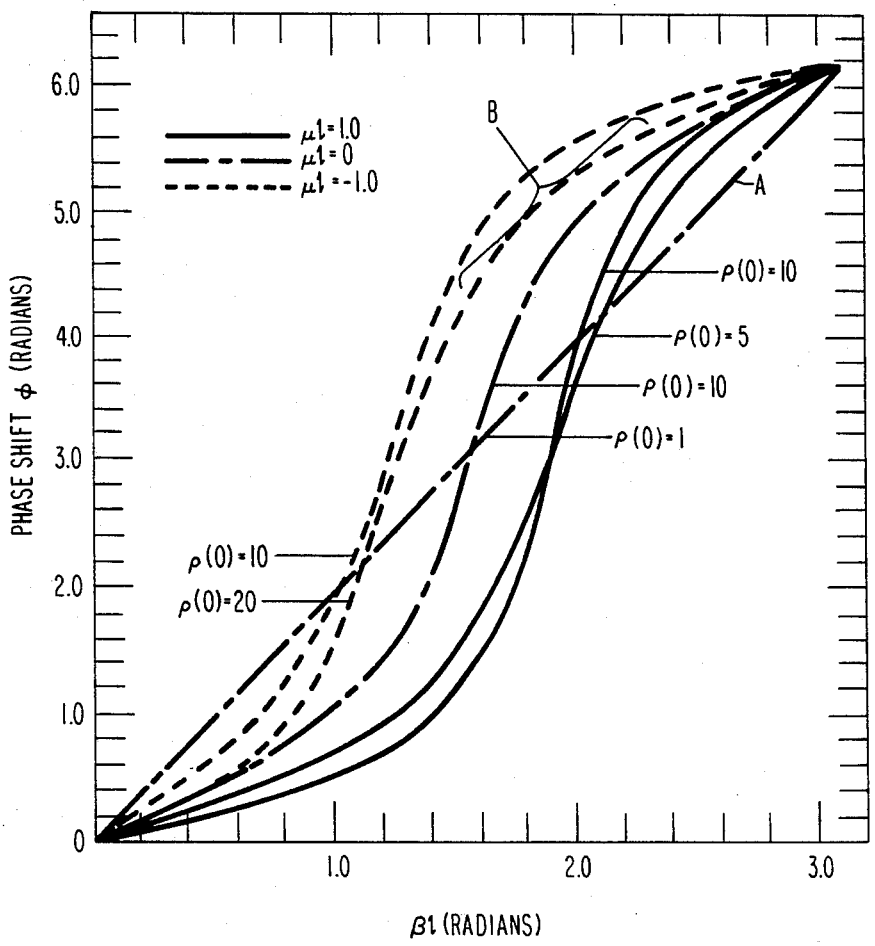
FIG. 3 is a plot of the phase shift of a coupled exponential transmission line (CETL) all pass network as a function of its electrical length with the ratio of its impedance $Z_{oe}$ to its impedance $Z_{oo}$ as a parameter.

Reference is now made to FIG. 3 which is a graph of the phase shift versus $\beta l$ characteristics of coupled exponential all-pass networks for selected values of $\mu l$. This FIGURE is copied from FIG. 10 on page 227 of an article entitled "Coupled Nonuniform Transmission Line and Its Application", by S. Yamamoto et al. which appeared in the *IEEE Transactions on Microwave Theory and Techniques,* Vol. MTT-15, No. 4, April 1967 at pages 220–231. The straight line A in FIG. 3 is the characteristic of a uniform transmission line ($\rho(0)=1$). The other curves are the characteristics of CETL networks having various values of $\rho$ and $\mu l$. By selecting an operating portion (such as B) of a CETL curve which is substantially parallel to the uniform transmission line curve, the CETL is provided with substantially the same phase-versus-frequency characteristics as the uniform line and the phase shifter itself is provided with a substantially constant phase shift versus frequency characteristic. Using this technique, phase shifters providing 45°, 90° and 180° of phase shift can be provided which have the frequency responses illustrated in FIG. 2.

By selection of appropriate values for its design parameters, the phase shifter 10 is constructed to provide a relative phase shift of 45° between the reference transmission line and the alternate transmission line across a frequency band centered at 10 GHz. A characteristic impedance ($Z_o$) of 50Ω is desired. This characteristic impedance $Z_o$ is equal to $\sqrt{z_{oe}z_{oo}}$ The substrate 12 is 25 mils (0.025 inch or 0.0635 centimeter) thick alumina which has a dielectric constant of 9.6. From FIG. 2 or the Table, it can be seen that a phase shift of 45°±2° can be obtained over an operating frequency range for which $\beta l$ (the electrical length of the CETL section) has a range of 105°–132°. This provides a bandwidth of 0.257 octaves. In order to center this operating bandwidth at 10 GHz the value of $\beta l$ for the center of the band is selected as 118.5°. The resulting phase shifter will provide a phase shift of 45°±2° over the frequency range from 8.86 GHz to 11.14 GHz. The value of $\rho(0)$ is selected as 3 and the value of $\mu l$ is selected as −0.5. From the value of $\beta l$ of 118.5° at 10 GHz the desired value of l is determined to be 0.9875 centimeter. From this value of l and the selected value of $\mu l$, the desired value of $\mu$ is found to be −0.50633. From the selected value of $\mu l$, P is found to be 0.7788. The value of p ($\mu l/2\beta l$) is −0.12088. This yields a value of q of 0.99267. From the values of $\beta$, q and l, the value of $\Theta$ is found to be 117.6311°. This yields a phase shift $\phi_a$ through the CETL section of 275.93856°. From the 45° phase shift curve in FIG. 2 it is seen that the relative phase shift provided by the phase shifter is a maximum at the center of the operating band. In consequence, in order to provide a phase shift of 45°±2° over the operating band, the relative phase shift or $\Delta\phi$ should be 47° at the center of the band. The relative phase shift $\Delta\phi$ is equal to ($\phi_a-\phi_r$) where $\phi_a$ is the phase shift experienced by the signal when it passes through the alternate transmission line and $\phi_r$ is the phase shift experienced by the signal when it passes through the reference transmission line. In consequence, the phase shift $\phi_r$ through the reference transmission line should be 228.93856° at 10 GHz. Since the phase shift $\phi_r=\beta l_r=228.93856°$, $l_r=1.90782$ centimeters. The values of $\phi_a$, $\phi_r$, and $l_r$ are for the CETL network and its corresponding portion of the reference transmission line. Connection of an equal length of uniform transmission line in series with each of the sections does not affect the relative phase shift. Consequently, as fabricated, the switches 27 and 29 are spaced apart by a convenient distance which is normally greater than $l_r$.

Since a value of three was chosen for $\rho(0)$, $Z_{oe}/Z_{oo}=3$. The degree of coupling between the two lines 25*a* and 25*b* of the CETL network is reflected in the voltage coupling coefficient $C_v$ which equals $$\frac{(Z_{oe}/Z_{oo})-1}{(Z_{oe}/Z_{oo})+1}.$$

For a $Z_{oe}/Z_{oo}$ ratio of three, the expression for $C_v$ reduces to a value of 0.5. $Z_{oe}$ is equal to $$Z_o\sqrt{\frac{1+C_v}{1-C_v}}$$

which reduces to a value of $Z_o\sqrt{3}$ which for a $Z_o$ of 50 ohms reduces to 86.6025. $Z_{oo}$ is equal to $$Z_o\sqrt{\frac{1-C_v}{1+C_v}}$$

which reduces to a value of $Z_o/\sqrt{3}$ for a $Z_o$ of 50 ohms reduces to 28.8675. $Z_o$ is equal to $\sqrt{Z_{eo}Z_{oo}}$ which for these values of $Z_{oe}$ and $Z_{oo}$ reduces to a value of 49.9999. Thus the desired 50 ohm characteristic impedance is obtained.

Figure 4:
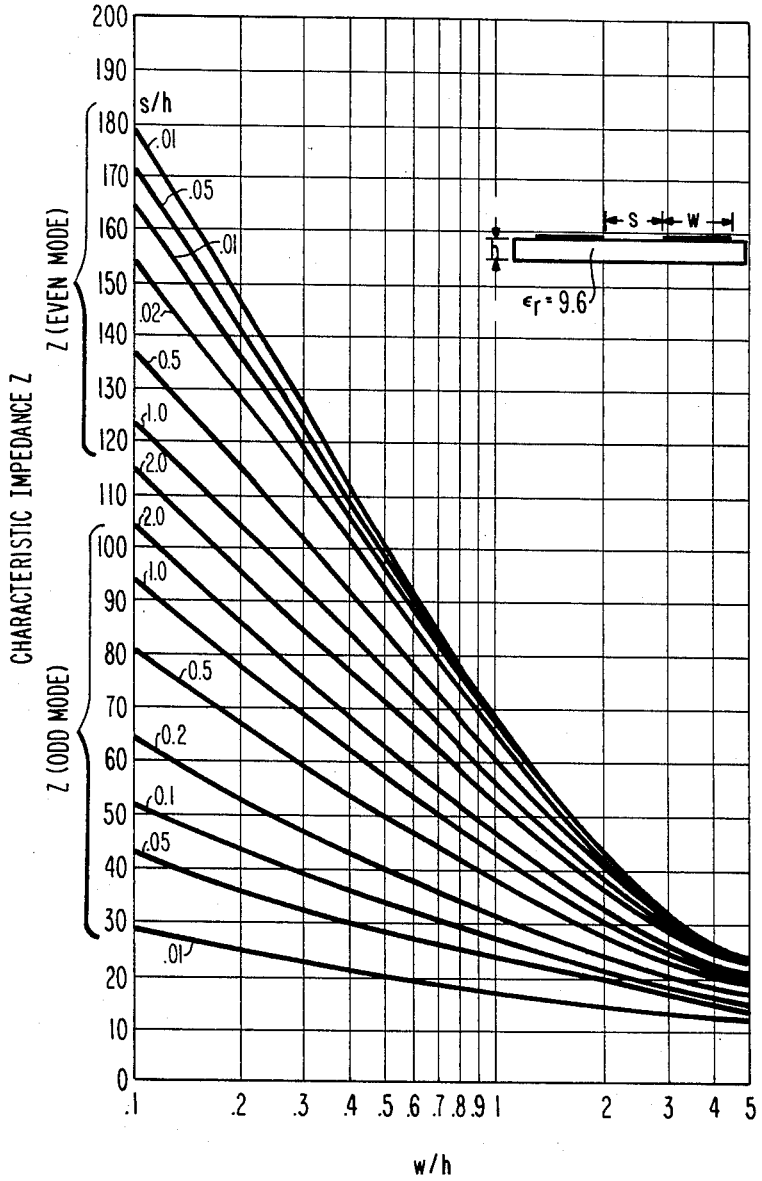
FIG. 4 is a plot of the even and odd mode impedances of coupled microstrip transmission lines as a function of the ratio of their width to the substrate thickness for a substrate having a dielectric constant of 9.6 with the ratio of the separation between the lines to the thickness of the substrate as a parameter.

FIG. 4 is a graph of the values of Z (even) and Z (odd) of a pair of coupled microstrip transmission lines fabricated on a substrate having a dielectric constant of 9.6. This graph plots the values of Z (even) and Z (odd) as a function of w/h with s/h as a parameter where "w" is the width of both narrow strips (25*a* and 25*b*) "h" is the thickness of the substrate and "s" is the spacing of (the separation between) the two narrow strips (25*a* and 25*b*). FIG. 4 is copied from FIG. 7 on page 447 of an article entitled, "An Octave-Band Switched-Line Microstrip 3-b Diode Phase Shifter" by Robert P. Coats which appeared in IEEE Transactions on *Microwave Theory and Techniques,* Vol. MTT-21, No. 7, July 1973 at pages 444–449.

From FIG. 4 and the values of $Z_{oe}$ and $Z_{oo}$, a w/h ratio of 0.6 was selected which for an even impedance of 86.6 ohms yields an s/h ratio of approximately 0.05. Using these values of w/h and s/h results in line widths of 15 mils (0.038 cm) and a separation 1.25 mil (0.0032 cm) both at x=0.

Other phase shifts and operating frequency ranges can be provided by appropriate selection of the values of the design parameters of the CETL network.

The Yamamoto et al. and the Coates articles both contain additional information which can be useful in understanding the design and operation of coupled transmission lines and are incorporated herein by reference. The Table shows that a 180° phase shifter using a CETL all-pass section has a bandwidth of 0.39 octave with the permissible phase error of ±2°. This characteristic is far superior to that of prior art 180° phase shifters which use a cascade of two 90° phase shift sections each containing a uniform, coupled line all-pass section.

The switches 27 and 29 may preferably employ p-i-n type diodes to control the connection of the transmission lines. A first diode connects strip 22 to strip 26 and a second diode connects strip 24 to strip 26. Bias is provided to these diodes so that one is forward biased while the other is reverse biased. A similar connection of PIN diodes comprises switch 29.

The phase shifter 10 is reciprocal. Consequently, its ports 16 and 18 are interchangeable and either may be connected to the source of a signal whose phase is to be switched. The other port is connected to the sink for the phase shifted signal.

For operational use the phase shifter 10 is connected in the transmission path of the signal whose phase is to be controlled. When a 0° relative phase shift is desired, the switches 27 and 29 are set to connect reference transmission line 20 between ports 16 and 18. When a relative phase shift of 45° is desired, the switches 27 and 29 are switched to connect the alternate transmission line 21 between the ports 16 and 18 in place of the reference transmission line. The CETL 25 maintains the difference in phase length between reference transmission line 20 and alternate transmission line 21 substantially constant at 45° (here ±2°) across the full designed operating frequency range of the phase shifter. The alternate transmission line 21 can be made a different number of degrees longer in phase length than reference transmission line 20 by appropriate modification of its design parameters.

If a one-port rather than a two-port phase shifter is desired, then port 18 may be omitted and switch 29 may be replaced by reflective terminations of the transmission lines 20 and 21.

Figure 5:
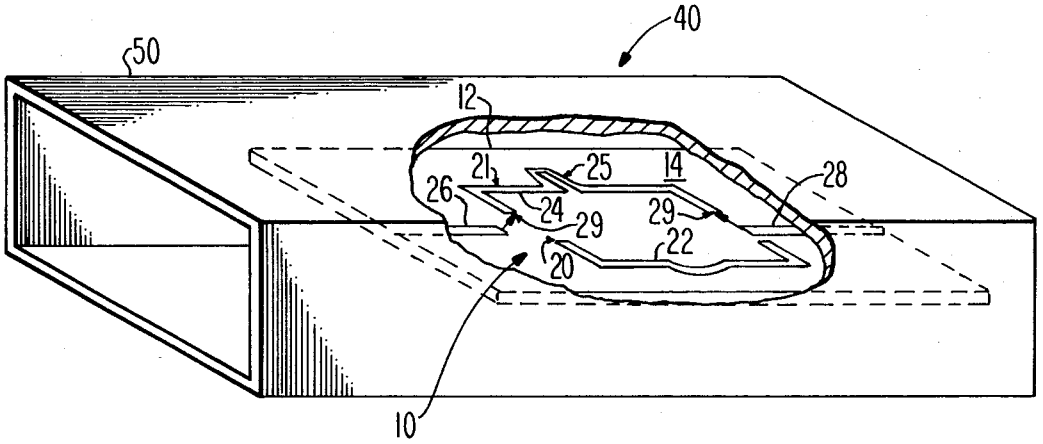
FIG. 5 is a perspective illustration of the phase shifter structure of FIG. 1 enclosed in a waveguide to form a suspended-substrate structure.

It is considered preferable for operational use in the millimeter wave region to form the phase shifter as a suspended-substrate structure 40 and to enclose the phase shifter structure 10 within a conductive rectangular waveguide 50 as illustrated in FIG. 5. The waveguide enclosure for the suspended-substrate structure prevents radiation from the transmission lines on the substrate 12 and concentrates any energy propagating through the waveguide within the transmission lines of this suspended-substrate structure. In this suspended substrate structure it is considered preferable to omit the ground plane from the second surface of the substrate. Under such conditions, it becomes possible to place the strip conductors of the reference and alternate transmission lines on opposing surfaces of the substrate if desired. However, for ease of fabrication, it is considered preferable to place the strip conductors of both transmission lines on the same surface of the substrate.

What is claimed is:

1. An RF phase shifter comprising: a dielectric substrate;

at least one RF signal port;

a reference RF transmission line comprising a first elongated conductor disposed on a first major surface of said substrate and having a reference phase length, said reference transmission line having a reference phase change versus frequency characteristic;

an alternate RF transmission line comprising a second elongated conductor disposed on a second major surface of said substrate and having an alternate phase length different from said reference phase length, said alternate transmission line including as a portion thereof, a coupled exponential transmission line comprising a segment of said second conductor, said segment having first and second ends disposed adjacent to each other and first and second halves extending substantially parallel from said first and second ends, respectively, to a common connection between them, said halves being spaced apart along their lengths by a separation distance, said coupled exponential transmission line having a continuous narrowing taper along its length from said first and second ends of said conductor segment to said common connection, the length of said halves, their separation distance, their width and said continuous narrowing taper together being tailored to provide said alternate RF transmission line with an alternate phase change versus frequency characteristic over an operating frequency range which is substantially the same as said reference phase change versus frequency characteristic; and means coupled between said at least one RF signal port and said reference and alternate transmission lines for selectively connecting either said reference transmission line or said alternate transmission line to said at least one RF signal port to select the one of said reference and alternate transmission lines which is connected to said at least one RF signal port as the existing RF signal transmission path through said phase shifter.

2. The phase shifter recited in claim 1 wherein said first and second major surfaces of said substrate are the same surface.

3. The phase shifter recited in claim 2 wherein:

said substrate has an additional major surface opposed to said same major surface; and said phase shifter further comprises a relatively wide ground conductor disposed on said additional major surface of said substrate whereby said transmission lines are microstrip transmission lines.

4. The phase shifter recited in claim 1 further comprising:

a waveguide enclosing said substrate to form a suspended-substrate structure, said waveguide and said phase shifter dimensioned for operation at millimeter-wave frequencies.

5. The phase shifter recited in claim 1 wherein said reference transmission line is a uniform transmission line.

* * * * *